US007761928B2

(12) United States Patent
Wang

(10) Patent No.: US 7,761,928 B2
(45) Date of Patent: Jul. 27, 2010

(54) CAP ASSEMBLY STRUCTURE WITH VARIOUS ACCESSORIES

(76) Inventor: Shao-Hua Wang, 5F.-1, No. 8, Sec. 3, Shuangshih Rd., Banciao City, Taipei County 220 (TW)

( * ) Notice: Subject to any disclaimer, the term of this patent is extended or adjusted under 35 U.S.C. 154(b) by 25 days.

(21) Appl. No.: 11/889,092

(22) Filed: Aug. 9, 2007

(65) Prior Publication Data

US 2009/0038045 A1 Feb. 12, 2009

(51) Int. Cl.
*A61F 9/00* (2006.01)

(52) U.S. Cl. ..... 2/10; 2/209.14

(58) Field of Classification Search ..... 2/12, 2/10, 13, 209.13, 209.12, 195.1; 351/155, 351/158; 24/33
See application file for complete search history.

(56) References Cited

U.S. PATENT DOCUMENTS 2,619,641 A * 12/1952 Vaca ..... 2/10
2,648,091 A * 8/1953 Jones ..... 16/336
2,654,089 A * 10/1953 Springer et al. ..... 2/10
4,991,068 A * 2/1991 Mickey ..... 362/106
5,129,102 A * 7/1992 Solo ..... 2/10
5,533,207 A * 7/1996 Diaz ..... 2/10
5,987,640 A * 11/1999 Ryder ..... 2/10
6,185,748 B1 * 2/2001 DeChambeau ..... 2/195.1
6,244,786 B1 * 6/2001 Johansson ..... 405/224.1
6,595,635 B2 * 7/2003 Schubert ..... 351/155
6,935,741 B2 * 8/2005 Denney ..... 351/155
6,938,273 B2 * 9/2005 Ko ..... 2/10
7,229,168 B2 * 6/2007 Kidouchim ..... 351/47

* cited by examiner

*Primary Examiner*—Katherine Moran
*Assistant Examiner*—Richale L Quinn
(74) *Attorney, Agent, or Firm*—Schmid PA

(57) ABSTRACT

A cap assembly structure has a sliding groove for attaching to the visor of a cap and a sliding anchor block attached to an accessory. The sliding groove, which has an inserting slot opening for receiving an I-shaped engaging slipper of the sliding anchor block, extends from the inserting slot opening end up to the other end such that the sliding groove has at least one ledge formed with a plurality of serrated notches for locking with the I-shaped engaging slipper to enable the wearer to assemble, disassemble, move and replace the accessories. The accessories can also be kept in holding elements when they are not in use.

5 Claims, 4 Drawing Sheets

CAP ASSEMBLY STRUCTURE WITH VARIOUS ACCESSORIES

FIELD OF THE INVENTION

The purpose of the present invention relates to an assembly structure between a cap and accessories (such as Goggles, illuminating lamp and the like) which provides a better structure for convenient assembly, disassembly, moving forward/backward, replacing and storing of the accessories.

BACKGROUND

For most people who undertake outdoor activities will wear headwear to prevent from sunburn and to avoid the direct sunshine by means of shelter function from the brim or visor of the headwear. However, the reflecting light ray and the sandy wind during the outdoor activities can not be completely blocked by such brim or visor of the headwear, many people will wear goggles or sunglasses accordingly so as to further provide an additional safety protection for eyes.

Therefore, various headwear and goggles almost become the necessary carrying protective equipment for people who undertake outdoor activities. A known cap has a magnet disposed on the visor to pull goggles with a corresponding magnet internally to fix it on the visor so that the goggles become an accessory in association with the cap.

However, the structural design of such cap with magnet for pulling and fixing the accessory of goggles has intrinsic drawbacks of unreliable positioning due to unable precisely retaining from the magnetic force and results in dropping the accessory of goggles off the cap due to extending action in larger degree of the user.

Moreover, other than the goggles, there are many other accessories to be used in connection with the cap. That the weight of some accessories might exceed the magnetic force of the magnet attached on the visor can bring the undesirable consequence out of expectation in the practicability and convenience of the entire contrivance.

SUMMARY OF THE INVENTION

In view of the facts aforesaid, the purpose of the present invention that improves the assembly structure in connection with the cap and accessories is to provide a better structure and method to conveniently assembly, disassembly, move, replace and effectively retaining the accessories.

The entire cap assembly structure basically comprises a sliding groove disposed on the visor and a sliding anchor block corresponding with the accessory, wherein the sliding groove, which has an inserting slot opening for receiving the sliding anchor block, extends from the inserting slot opening end up to the other end such that the sliding groove has at least one ledge formed with a plurality of serrated notches to lock with the I-shaped engaging slipper, which is configured between the sliding anchor block and the accessory.

Thereby, the accessory can be slid into or out of the inserting slot opening of the sliding groove and firmly secured there with the cap when the I-shaped engaging slipper is locked between desired two tines of the serrated notches so as to achieve the object of convenient assembly/disassembly operation of the accessories and to keep them in the holding elements.

DETAILED DESCRIPTION OF THE PREFERRED EMBODIMENT

Figure 1:
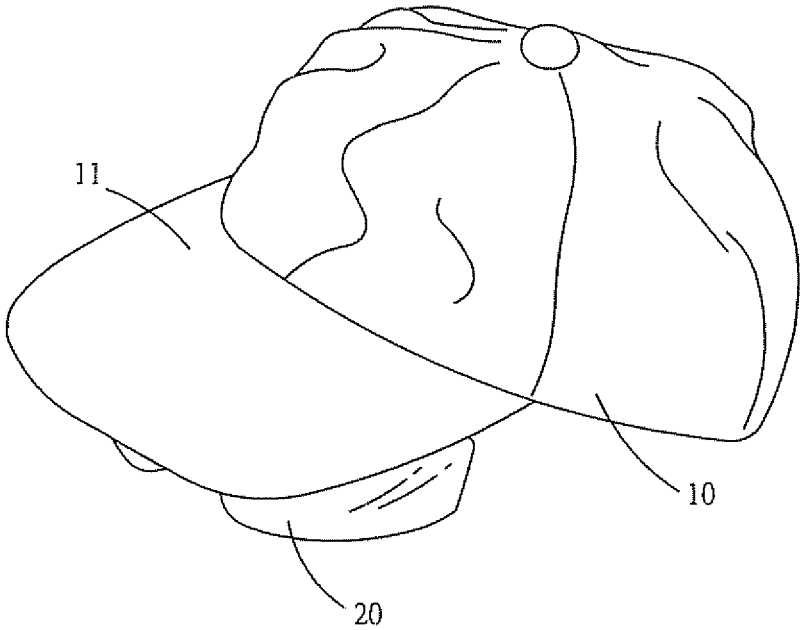
FIG. 1 is the illustrative view in operational status of the cap with accessories for the present invention.

For the purpose of rendering your honor examiners to clearly understand the structure of the related components and the integral operational method for the present invention, we will explain and describe in association with the accompanying drawings as below:

As shown in the FIG. 1, the present invention primarily provides a cap assembly structure with various accessories so that it can effectively fix and adjust the relative positions of the accessories of goggles 20, illuminating lamp 21 and the like on the visor 11 of the cap 10; It also enables the wearer to assemble, disassemble, move and replace the accessories mentioned above.

Figure 2:
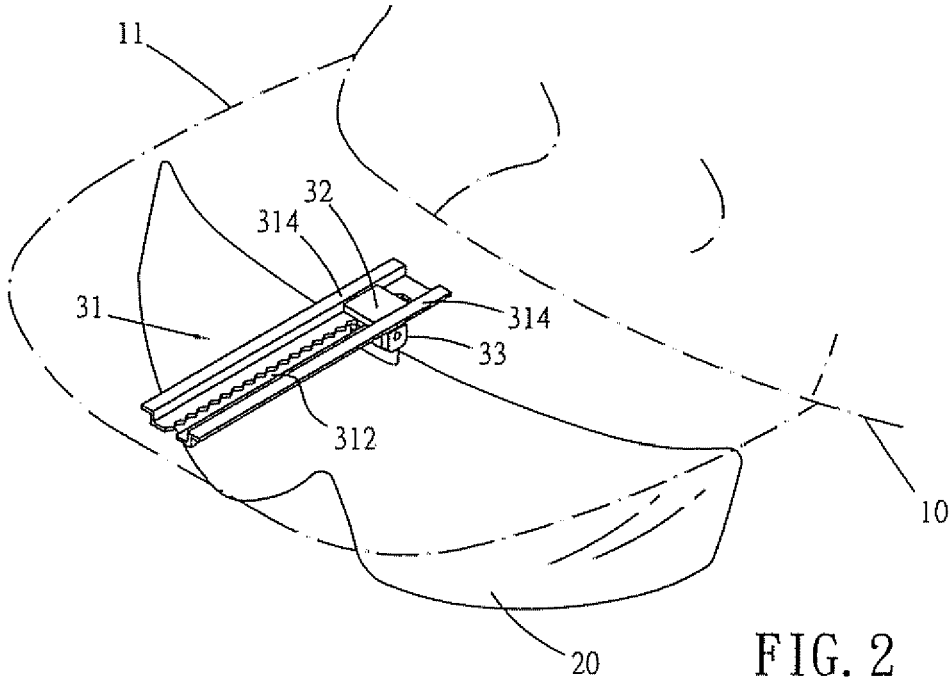
FIG. 2 is the perspective view of the cap appearance in assembly structure status for the present invention.
Figure 3:
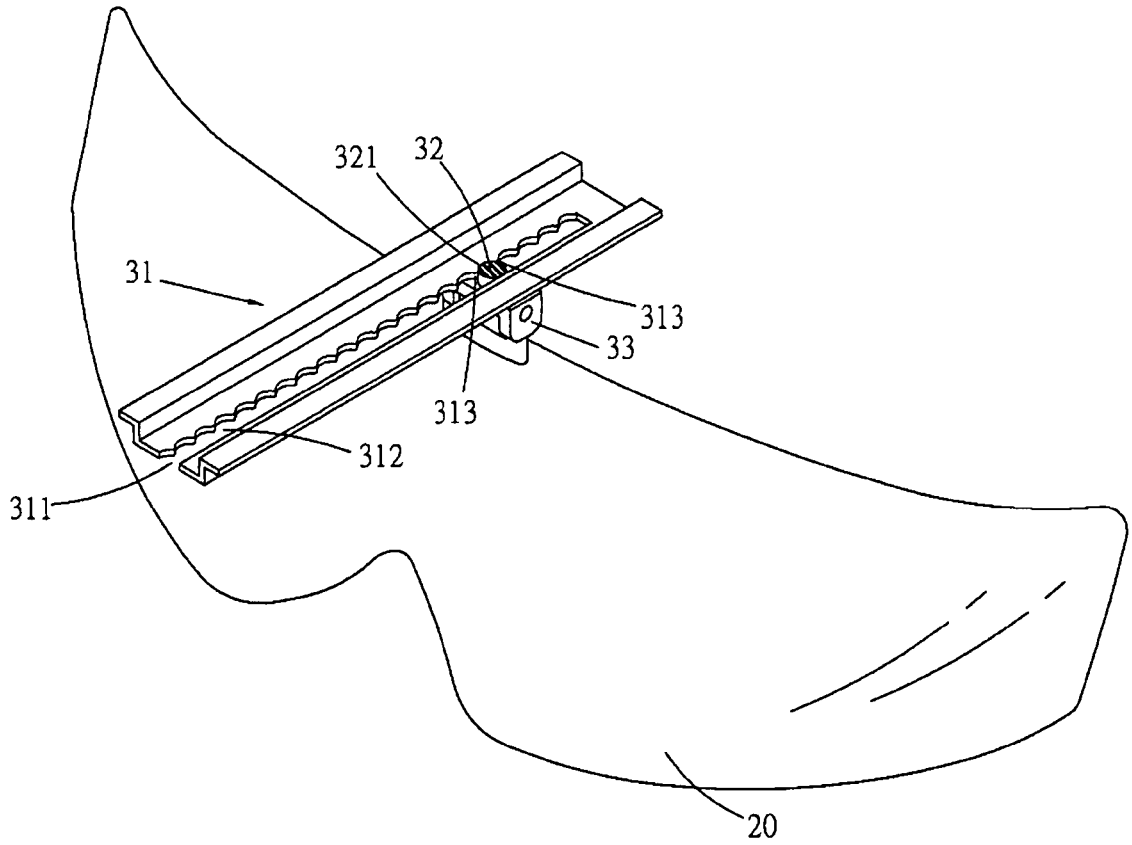
FIG. 3 is the structural section view of the sliding groove and sliding anchor block for the present invention.

Referring to FIG. 2 and FIG. 3, the entire cap assembly structure basically comprises a sliding groove 31, a sliding anchor block 32 and a pivotable carrier 33.

The sliding groove 31, which being lengthwise disposed at the center down side of the visor 11 with an inserting slot opening 311 at the distal end thereof, extends from said inserting slot opening 311 end up to the other end near the seam between the visor 11 and the gores of the cap 10 body such that the sliding groove 31 has at least one ledge with a plurality of serrated notches 313 to lock with an I-shaped engaging slipper 321. The I-shaped engaging slipper 321 is configured between the sliding anchor block 32 and the accessory of goggles 20.

The sliding anchor block 32 in corresponding with the accessory of goggles 20 has a I-shaped engaging slipper 321 integrated beneath to slip into the inserting slot opening 311 for moving along an inserting slot 312 of the sliding groove 31

The pivotable carrier 33 located under the sliding anchor block 32 as a unitary body therewith and serves to hold the accessory of goggles 20.

During assembly of the accessory of goggles 20, the sliding anchor block 32 of the goggles 20 is aligned and slipped forwardly into the inserting slot opening 311 of the sliding groove 31 and slid along the sliding groove 31 by means of the confinement of the sliding groove 31 on the sliding anchor block 32. The goggles 20 can be slid to the proper position and firmly secured there with the cap 10 when the I-shaped engaging slipper 321 of the sliding anchor block 32 is locked between desired two tines of the serrated notches 313. The tilt angle of the accessory of goggles 20 can also be adjusted by the function of the pivotable carrier 33.

During disassembly of the goggles 20, the operational procedure is naturally reversible, namely the sliding anchor block 32 of the goggles 20 is slid backwardly along the sliding groove 31 up to out of the inserting slot opening 311 of the sliding groove 31 so that the goggles 20 are released and separated from the cap 10. Accordingly, the inserting slot opening 311 of the sliding groove 31 facilitates the user to conveniently assemble, disassemble or replace the accessory of goggles 20 quickly.

Figure 4:
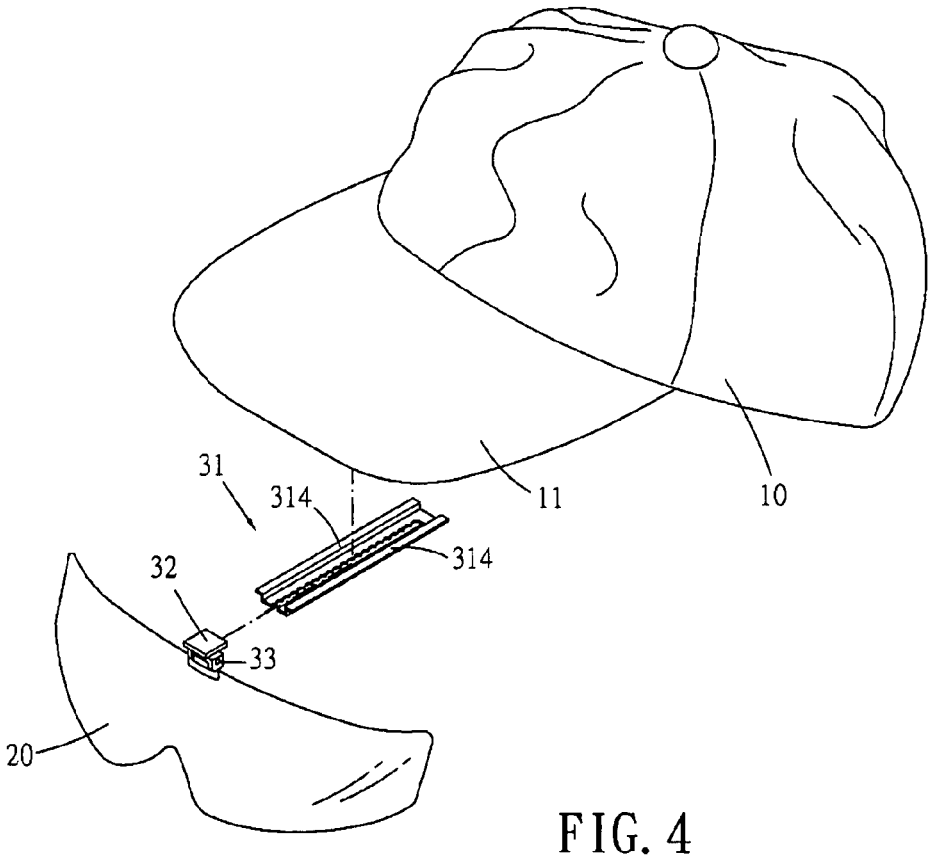
FIG. 4 is the exploded structural fragment view of the sliding groove and sliding anchor block in decomposition for the present invention.

The sliding groove 31 is preferably made of thermoplastic material and molded with the visor 11 of the cap 10 into a unitary body. Alternatively, as shown in the FIG. 4, the latching assemblies 314 are closely attached with the visor 11 on both sides of the sliding groove 31 so that ultrasound can be used to adhere the sliding groove 31 to the visor 11 of the cap 10 by means of melting, gluing or seaming methods. This allows the sliding groove 31 to maintain structural stability and strength, thus, the sliding anchor block 32 inserted therein is adequately fixed so as to withstand shaking due to activities of the user.

For the exemplary embodiments shown in the FIG. 1 through FIG. 4, the accessory used in association with the cap 10 is the goggles 20 for the protective purpose of sheltering the blaze shining to the eyes or blocking sandy wind, or the accessory might even be the optical lens with dioptric degree.

Figure 5:
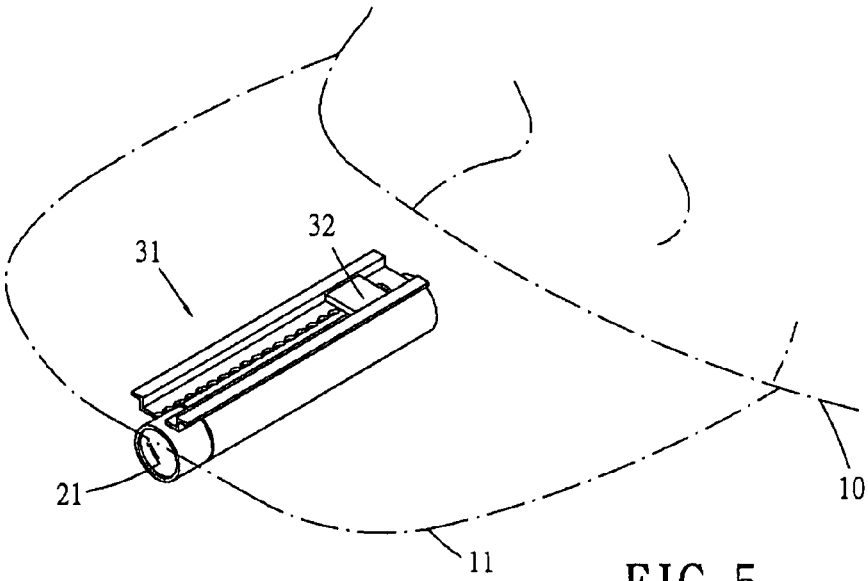
FIG. 5 is another illustrative view in operational status of the cap with accessories for the present invention.

Naturally, the accessory can also be changed in accordance with the requirement of the activity undertaken by the user such as the accessory of an illuminating lamp 21, which can be specially equipped with a control switch and an adjuster on the front end, as shown in FIG. 5 in association with the cap 10. The illuminating lamp 21 can replace the accessory of the goggles 20 so as to promote the convenience of activities at night or in a dark environment so that personal safety can be ensured.

Figure 6:
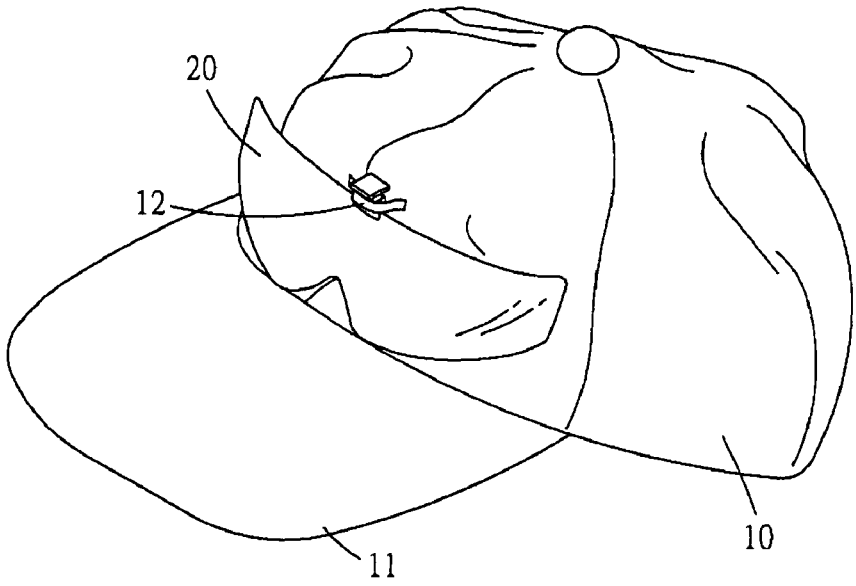
FIG. 6 is the illustrative view in operational status of the cap with accessories for second exemplary embodiment of the present invention.
Figure 7:
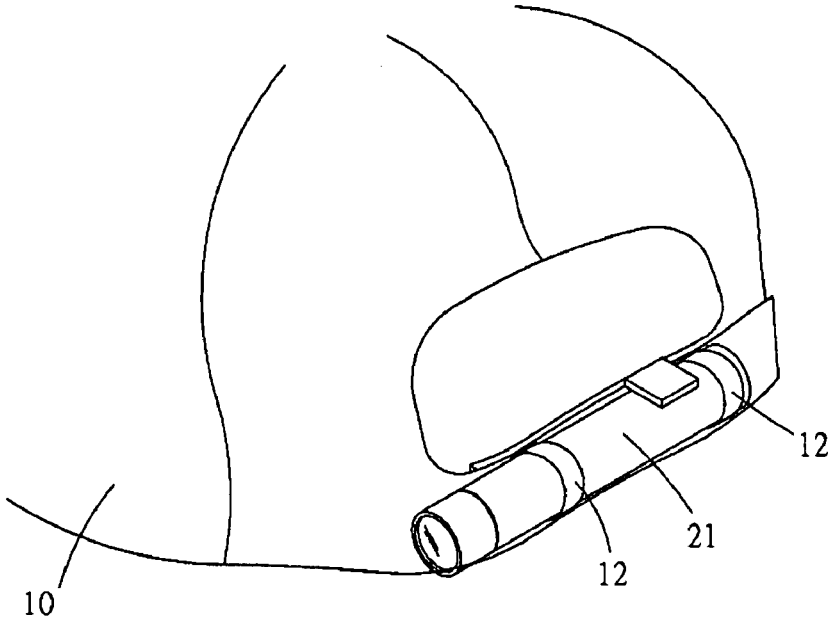
FIG. 7 is the illustrative view in operational status of the cap with another accessory for second exemplary embodiment of the present invention.

Moreover, as shown in FIG. 6 and FIG. 7, the cap 10 attached with the accessories of goggles 20 and illuminating lamp 21 can be additionally disposed with at least one holding element 12 on the outside of the sliding groove 31 for the purpose of storing the accessories. The holding elements 12 can be elastic bands separately set on the upper side of the visor 11 corresponding to the forehead of the wearer and set at the rear side of the cap 10 corresponding to the adjusting band so that the accessory of goggles 20 and the like can be kept in the holding element 12 on the upper side of the visor 11 (as shown in the FIG. 6) and the accessory of an illuminating lamp 21 and the like can be kept in the holding element 12 at the rear side of the cap 10 (as shown in the FIG. 7) when the accessories are not disposed in the sliding groove 31 of the cap 10. Thereby, the user can conveniently carry both of the accessories of goggles 20 and illuminating lamp 21 with himself/herself simultaneously.

In conclusion and in view of the foregoing descriptions for the cap and the accessories, the present invention provides a more feasible assembly structure with creative novelty and application improvement, which means meeting with the patentable criterion. Accordingly, we submit the patent application of the present invention to you in accordance with the relevant patent laws for your perusal and examination. However, all the foregoing elaboration heretofore is only to provide a concrete description of the preferred exemplary embodiment of the feasible mode for the present invention, which is not intended to limit the patent claim of the present invention. Any equivalent embodiment or alteration on the structure, devices and feature, which does not depart from the technological spirit and essence of the present invention, should be included in the patent claims of the present invention.

What is claimed is:

1. A cap assembly structure for mounting an accessory on a cap body having a visor portion and a crown portion, comprising:

a plurality of accessories, including a pair of goggles and an illuminating lamp;

a sliding groove configured to be disposed on a bottom side of the visor portion, the sliding groove having a slot opening disposed at a distal end thereof and a slot configured to extend from the slot opening to a position adjacent a seam between the visor portion and the crown portion, wherein a plurality of serrated notches are formed in the sliding groove along at least one lateral edge of the slot;

a sliding anchor block configured to slide in said sliding groove for adjusting a position on each of the accessories, wherein the accessories are used interchangeably; and an I-shaped engaging slipper coupled to a bottom portion of the sliding anchor block for engaging the serrated notches to lock the accessory in a desired position.

2. The cap assembly structure of claim 1, wherein the sliding groove has latching assemblies on both sides thereof for attaching the sliding groove to the visor portion.

3. The cap assembly structure of claim 1, wherein at least one holding element for storing the accessory when the accessory is not in use is disposed at a position outside of the sliding groove.

4. The cap assembly structure of claim 3, wherein said holding element is an elastic band.

5. The cap assembly of claim 1, further including a pivotable carrier coupled to a bottom portion of the sliding anchor block for permitting tilting of the accessory.

* * * * *